US005843488A

United States Patent [19]

Korsch et al.

[11] Patent Number: 5,843,488

[45] Date of Patent: Dec. 1, 1998

[54] DEVICE FOR POSITIONING FACON MOLDS

[75] Inventors: Wolfgang Korsch; Peter Sommerfeld, both of Berlin, Germany

[73] Assignee: Korsch Pressen GmbH, Berlin, Germany

[21] Appl. No.: 676,320

[22] PCT Filed: Jan. 16, 1995

[86] PCT No.: PCT/EP95/00148

§ 371 Date: Aug. 30, 1996

§ 102(e) Date: Aug. 30, 1996

[87] PCT Pub. No.: WO95/19254

PCT Pub. Date: Jul. 20, 1995

[30] Foreign Application Priority Data

Jan. 15, 1994 [DE] Germany ..... 44 01 359.0

[51] Int. Cl.[6] ..... B30B 15/02

[52] U.S. Cl. ..... 425/193; 425/195; 425/345

[58] Field of Search ..... 425/193, 195, 425/345, 353

[56] References Cited

U.S. PATENT DOCUMENTS 2,989,781 6/1961 Frank .

3,318,265 5/1967 Winters et al. .

3,565,016 2/1971 Christie ..... 425/195

5,116,214 5/1992 Korsch et al. ..... 425/345

5,635,223 6/1997 Korsch et al. ..... 425/345

FOREIGN PATENT DOCUMENTS 806035 6/1951 Germany .

*Primary Examiner*—James P. Mackey

*Attorney, Agent, or Firm*—McGlew and Tuttle

[57] ABSTRACT

A device for positioning in a mold table of a tabletting machine, in particular a rotary tabletting machine with facon molds that have molding cavities and form a circular cylinder on an outer perimeter. Each facon mold has at least one centering area associated with the molding cavity and for each facon mold, a centering piece is movably mounted on the mold table to engage the centering area of the facon mold. The centering area in cooperation with the centering piece properly positions the facon mold to the upper ram of the tabletting machine.

11 Claims, 6 Drawing Sheets

6
22
28
30
31
29
11
5
7
4
20
19
17
10
18

DEVICE FOR POSITIONING FACON MOLDS

FIELD OF THE INVENTION

The present invention pertains to a device for fixing shaped dies, which are provided with mold cavities and are circular cylindrical on their outer circumference, in the die table of a tabletting press, especially a rotary tabletting press.

BACKGROUND OF THE INVENTION

Modern tabletting presses are suitable for pressing tablets of various types and shapes. The adjustment of the individual dies to the upper and lower punches is not necessary in the case of circularly symmetrical tablets. If a circularly symmetrical tablet is to have lettering on both sides or is to have predetermined breaking scores on both sides, the adjustment of the upper punches and lower punches in relation to one another is important. This has hitherto been done by means of guide sleeves provided with grooves for the upper punch and the lower punch. Adjustment of the die with circularly symmetrical hole to the punches is not necessary.

If the shape of the tablet is not circularly symmetrical, so-called shaped dies are needed, and the adjustment of the upper and lower punches to one another alone is not sufficient. Shaped dies are dies which are circularly cylindrical on the outer circumference and whose mold cavity is aligned asymmetrically rather than rotationally symmetrically to the axis of the die. To make it possible to prepare asymmetric tablets in mold cavities, the upper and lower punches must be adjusted to one another and to the mold cavity of the shaped die.

To fix shaped dies in the prior-art devices, an upper curve segment is removed in the curve path for the upper punch. The upper punch is then guided by the upper guide sleeve of the rotor of the tabletting press. The shaped die is subsequently pressed into the die hole of the die table by means of the upper punch. The upper punch and the shaped die are thus adjusted to one another. While the upper punch fixes the shaped die, the latter is fastened by means of the corresponding die holders. The upper punch is then again moved up and down for checking, and the die wall of the shaped die should not be touched. It is now checked whether the upper punch and the shaped die are still adjusted correctly to one another. The shaped die may thus be displaced tangentially with the die holders during the fastening. The entire fixation process must be repeated in this case. The situation is similar if the upper punch touches the shaped die for checking during the repeated lowering of the upper punch. The fixation of the shaped die in relation to the upper punches is tantamount to the fixation of the shaped die in relation to the lower punches, because these are aligned with the upper punches due to the respective guide sleeves and their grooves. This laborious and time-consuming fixation of the shaped dies in relation to the upper punches means machine downtimes. However, since modern tabletting presses represent a high investment value, short downtimes must be achieved.

SUMMARY AND OBJECTS OF THE INVENTION

The basic object of the present invention is to provide a device with which the shaped dies can be fixed in relation to the upper punches in a simple manner.

According to the invention, a device for fixing shaped dies is provided. The shaped dies are provided with nonrotationally symmetrical mold cavities and are circularly symmetrical on an outer circumference. The dies are fastened by means of die holders engaging annular T-slots in a die table of a tabletting press, particularly a rotary tabletting press. Each shaped die has at least one centering surface associated with the nonrotationally symmetrical mold cavity. One centering piece, engaging the centering surface, is detachably movably arranged on the die table for each of the shaped dies. By using shaped dies with centering surfaces associated with the mold cavity, the centering surfaces can be fixed with a centering piece in relation to the upper punches of the tabletting press in a simple manner, as a result of which the machine downtimes for replacing the shaped dies are greatly reduced. The centering pieces are mounted detachably or movably, especially axially or vertically displaceably, so that round, standard dies can also be used instead of the shaped dies.

The centering piece is preferably detachably fastened with a tightened screw and has a guide pin for accurate positioning in the die table. A tapered pin may be provided for fixing the centering piece. A straight pin may also be provided for fixing the centering piece.

The centering piece is preferably arranged axially displaceably in a guide groove arranged on an under side of the die table. The centering piece is preferably provided with an elongated hole, through which a tightening screw extends.

The centering piece may be designed as a spring-loaded guide pin, which is inserted into a hole of the collar in an underside of the die table and which elastically engages a centering surface designed as a centering hole, on a underside of the shaped die.

The centering piece may also be designed as a centering disk which is rotatably mounted on an underside of the die table and is provided with a first centering surface on a circumference for engaging the centering surface of the shaped die and with a second arc-shaped centering surface which is aligned with the circularly cylindrical mounting hole for the shaped dies, after a rotation of the centering disk.

The centering disk may also be provided with external teeth over a part of its circumference which engage external teeth of a rotatable toothed ring for rotating the centering disk.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS In the drawings.

DESCRIPTION OF THE PREFERRED EMBODIMENTS

Figure 1:
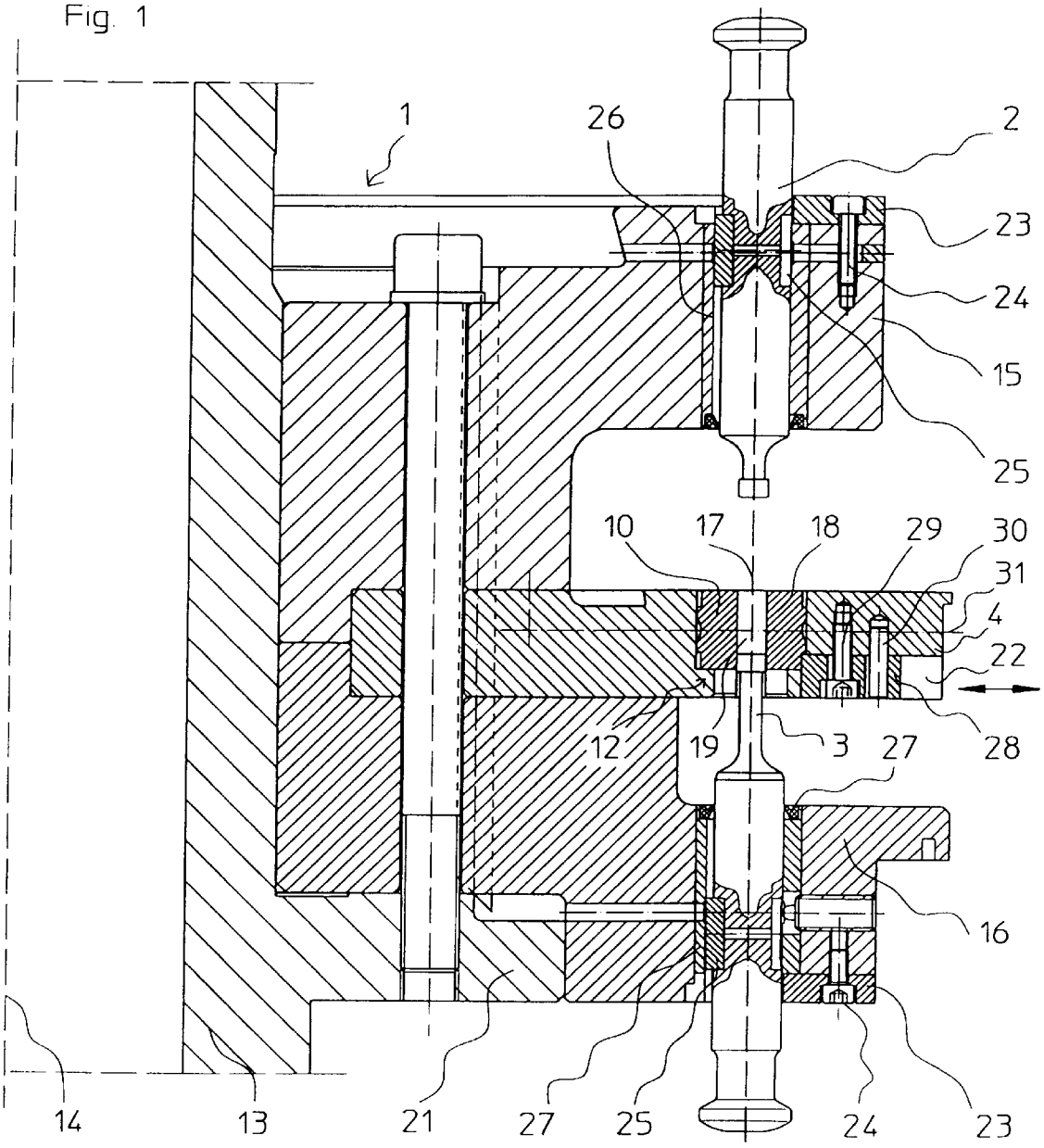
FIG. 1 is a vertical partial sectional view through a rotary tabletting press according to the first embodiment of the die-fixing device.

The rotary tabletting press 1 comprises a die table 4, which is connected to a rotor 21, is driven by a drive shaft 13 rotating around a vertical rotor axis 14 and is formed by the rotor upper part 15 and the rotor lower part 16, in which the upper punch 2 and the lower punch 3 are guided, respectively. These are guided in guide sleeves 26, 27 and are adjusted in them with feather keys 25 engaging grooves. The guide sleeves 26, 27 are nonrotatably fastened to the rotor upper part 15 and to the rotor lower part 16 with a fitting piece 23 each with a corresponding screw 24.

A plurality of shaped dies 10, which are circularly cylindrical on the outer circumference, are arranged uniformly distributed on the pitch circle 17 of the die table 4 in mounting holes 6, which are provided with a lower collar 12 of reduced diameter, on which the shaped die 10 is placed. When the die table 4 rotates during the operation of the rotary tabletting press, the shaped dies 10 with the upper and lower punches 2, 3 associated with them reach one after another a pressing station, in which the filling filled into the empty shaped dies 10 by means of filling shoes prior to a pressing process is pressed into finished tablets by means of pressure rollers. The pressing station, the filling shoes, and the pressure rollers are not shown.

Figure 2:
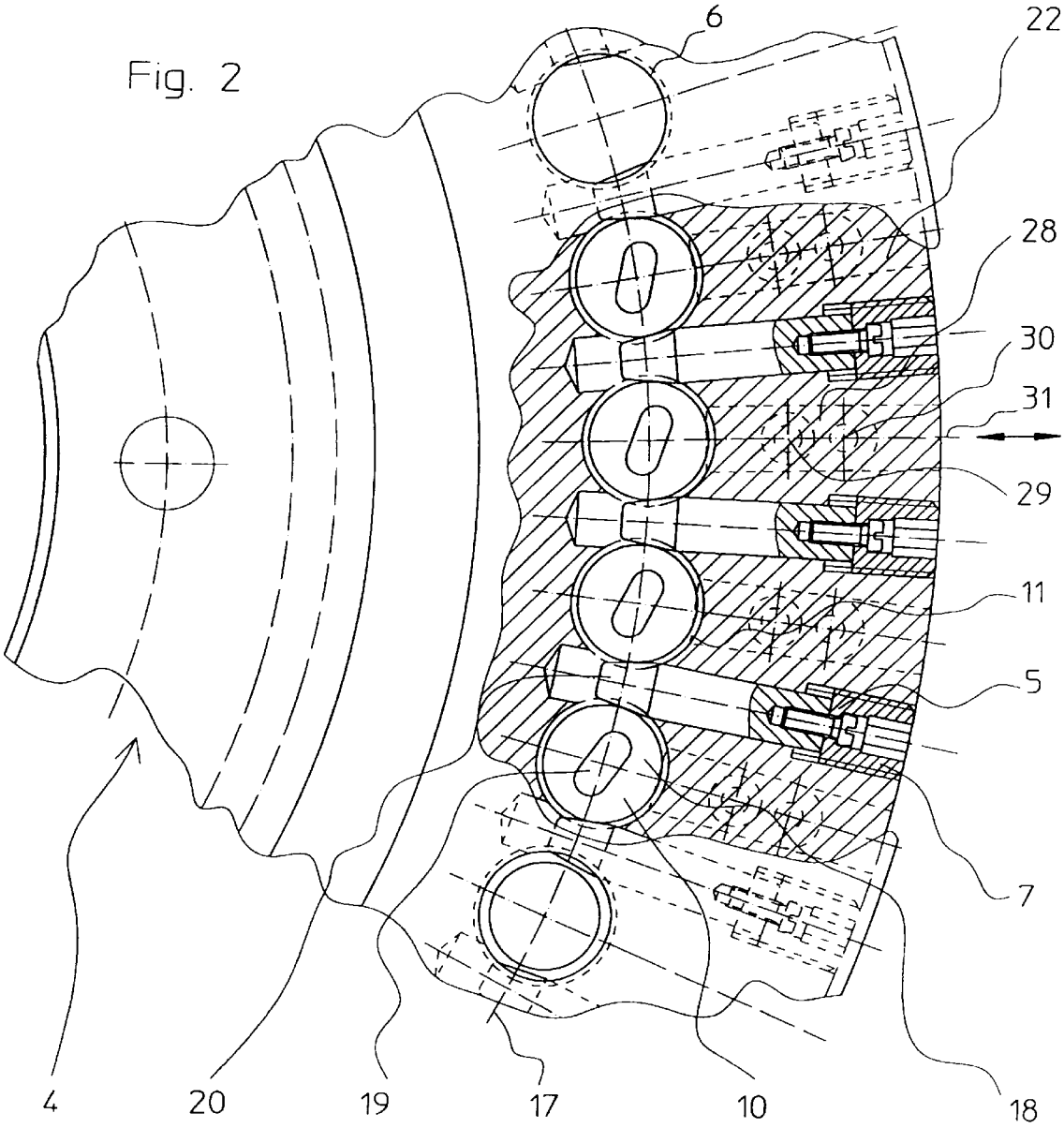
FIG. 2 is a partial top view of the die table according to FIG. 1, partly as a sectional view.

Shaped dies are dies which are circularly cylindrical on the outer circumference, but whose mold cavity is aligned asymmetrically rather than rotationally symmetrically to the die axis. To fasten the shaped dies 10 in the die table 4, die holders 7 are provided, which are shown in FIG. 2, are designed as die screws 5, are guided radially from the outside in the direction of the axes 31 between two shaped dies 10 each and engage annular T-slots 11 of the shaped dies 10.

Figure 3:
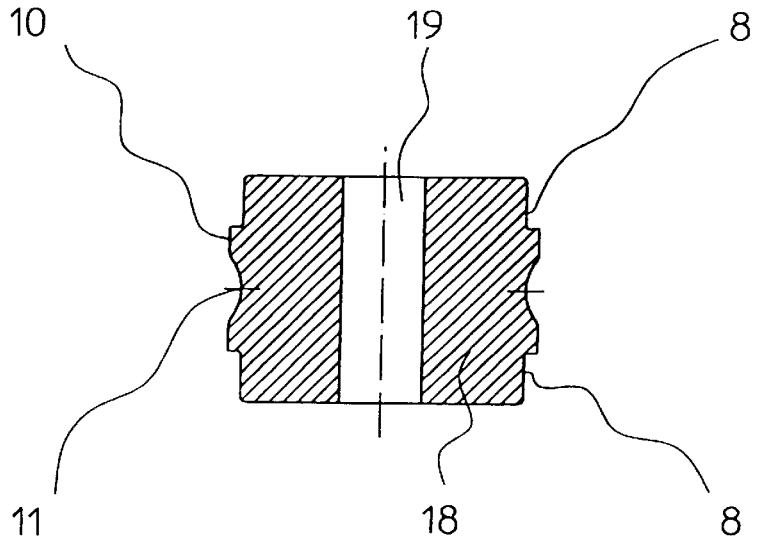
FIG. 3 is a sectional view through a shaped die.
Figure 4:
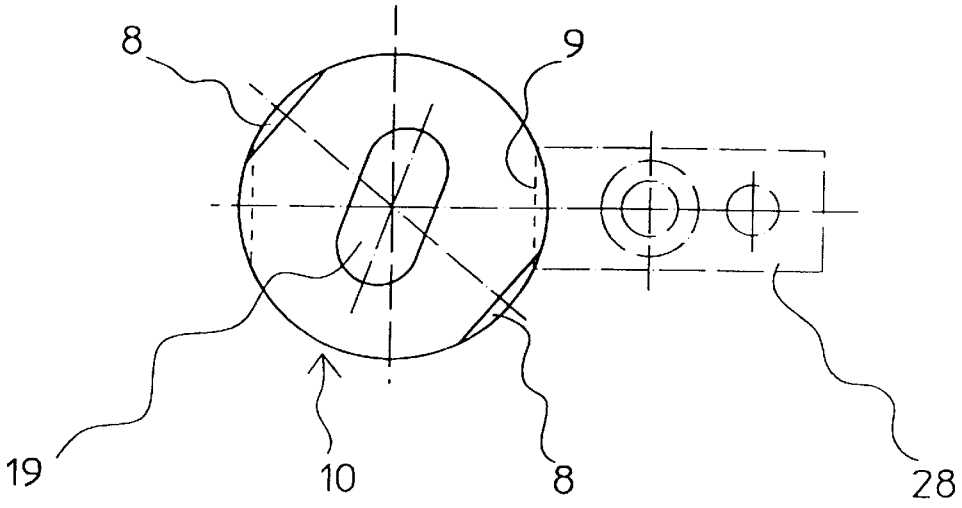
FIG. 4 is a top view of the shaped die.

According to FIGS. 3 and 4, each shaped die 10 comprises a round, metallic die body 18 and a mold cavity 19, which forms the shaped mold for pressing the tablets. The mold cavity 19 has the shape of an oblong tablet, but it may also have any other negative shape of an asymmetric tablet. The shaped die 10 has the annular T-slot 11 approximately in the middle of the outer circumference, and it also has one or more centering surfaces 8 on the lower and/or upper edge areas for engaging a centering piece 28, which is introduced into the die table 4 laterally from below and with which the shaped dies 10 are fixed in the die hole 6 in the die table 4. The centering surface 8 is designed, e.g., as a radial groove on the bottom of the shaped die 10, which is engaged by the centering piece 28. A tightening screw 29 and a guide pin 30 are used for more accurately positioning the centering piece 28. After the fixation of the shaped dies 10 by means of the centering pieces 28, the shaped dies 10 are fastened by means of the die screws 5. To do so, the die screws 5, provided with conical heads, are radially introduced between two shaped dies 10 each from the outside. The conical heads of the die screws 5 penetrate into the annular T-slots 11 of the shaped dies 10 and thus fasten the shaped dies 10 in the die table 4.

The centering piece 28 used to fix the shaped die 10 is hardened; it is inserted into the radial guide groove 22 of the die table 4 from below and is accurately positioned with a tightening screw 29 and a guide pin 30. The guide groove 22 associated with the shaped die 10 and the centering piece 28 are provided with very finely finished, accurate centering surfaces. The edges of the centering pieces 28 and of the shaped dies 10 are beveled at about 15° to facilitate the insertion of the shaped die 10 with the centering surface 8 on the centering surface 9 of the centering piece 28. Due to the shaped die 10 being adjusted by means of the centering surfaces 8, 9 in relation to the centering piece 28, the shaped die 10 is also in an adjusted state in relation to the upper punch 2. The introduction edges of the guide groove 22 for the centering piece 28 are beveled at an angle of about 45° to facilitate the insertion of the centering piece 28 into the guide groove 22. Due to the conical die pin 20 of the die screw 5, the shaped die 10 is in contact with the lower collar 12 of the die hole 6 of the die table 4 under pressure.

After the fixation of the shaped dies 10 by means of the centering surfaces 8, 9 by the centering pieces 28 in the guide grooves 22 and after the fastening of the shaped dies 10 with the die screws 5 in the die table, the upper and lower punches 2, 3 are mounted in the guide sleeves 26, 27.

The necessary centering surfaces 8 on the underside of the shaped die 10 can be prepared by a simple finishing of existing shaped dies 10. The shaped die 10 may be provided with a plurality of centering surfaces 8. The shaped die 10 can thus be removed after prolonged use, turned by 180° and reinstalled. Uniform wear and longer service life of the shaped die 10 are guaranteed as a result. The shaped die 10 may also be provided with four centering surfaces 8 on the top side and the underside. The two additional centering surfaces 8 on the top side also make it possible to turn the shaped die 10 around, with a subsequent possibility of rotation, besides the rotation by 180°. If shaped dies 10 with four centering surfaces 8 are used, the wear becomes distributed even more uniformly on the entire shaped die 10. The service life can be expected to increase fourfold compared with a shaped die 10 with only one centering surface 8. The centering surfaces 8 arranged on top on the surface of the die table 4 may be sealed with silicone to prevent dust from penetrating.

Besides the above-mentioned fixation of the shaped dies 10 by means of the centering pieces 28 with associated tightening screws 29 and guide pins 30, the fixation of the shaped dies 10 may also be performed by means of tapered or straight pins.

Only round, standard dies without centering surfaces 8 can be used when the centering pieces 28 are removed in the first embodiment according to FIGS. 1 through 4 described above. To make it possible to universally use both round, standard dies for round tablets, for which no die fixation is necessary, and shaped dies 10, the second through fourth embodiments of the die-fixing device according to FIGS. 5 through 10 are provided.

Figure 5:
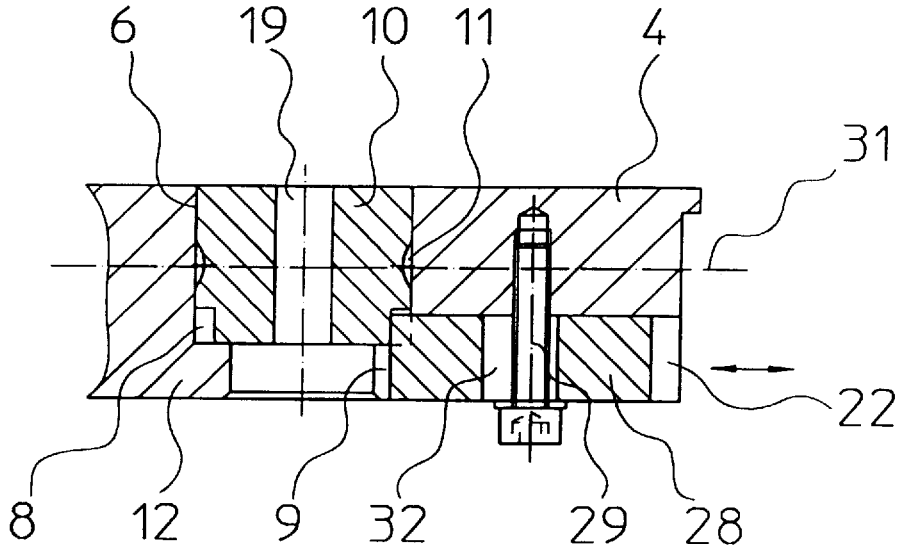
FIG. 5 is a vertical sectional view through the second embodiment of the die-fixing device.
Figure 6:
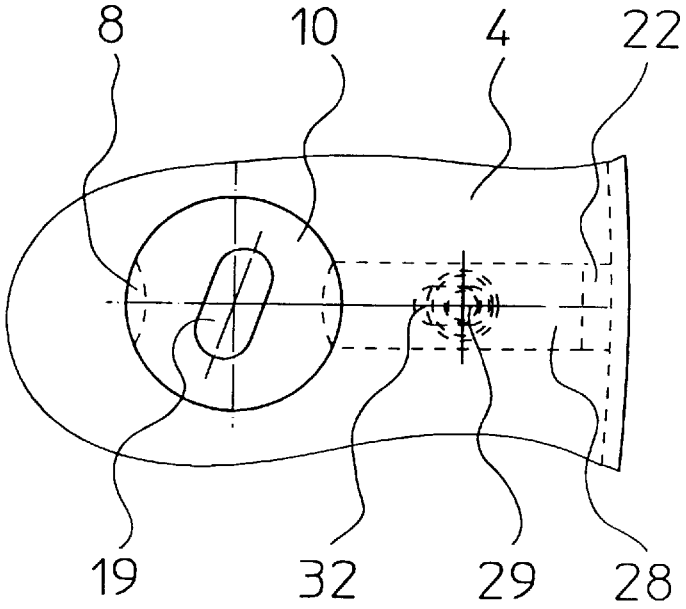
FIG. 6 is a top view of the embodiment of FIG. 5.

In the second embodiment of the die-fixing device according to FIGS. 5 and 6, the plate-shaped die table 4 is shown with the shaped dies 10, the associated adjusting surfaces 8 and with the centering piece 28 with the centering surface 9, wherein the centering piece 28 is guided in the radial groove 22 on the underside of the die table 4. The centering piece 28 used to fix the shaped die 10 is provided with an elongated hole 32 extending in the direction of the radial groove 22, through which extends the tightening screw 29, which can be screwed into the die table 4 and by means of which the centering piece 28 is clamped onto the die table 4. In the representation according to FIGS. 5 and 6, the centering piece 28 is radially displaced against the shaped die 10, so that the centering piece 28 extends into the mounting hole 6 of the shaped die 10 in the die table 4. Thus, the shaped die 10 can be inserted only when the centering surface 8 matches the contour of the centering surface 9 on the front side of the centering piece 28. If round, standard dies are to be used, which have no centering surfaces 8, the centering piece 28 is displaced in the outwardly direction, i.e., to the right in the drawing according to FIG. 5, after loosening the tightening screw 29.

Figure 7:
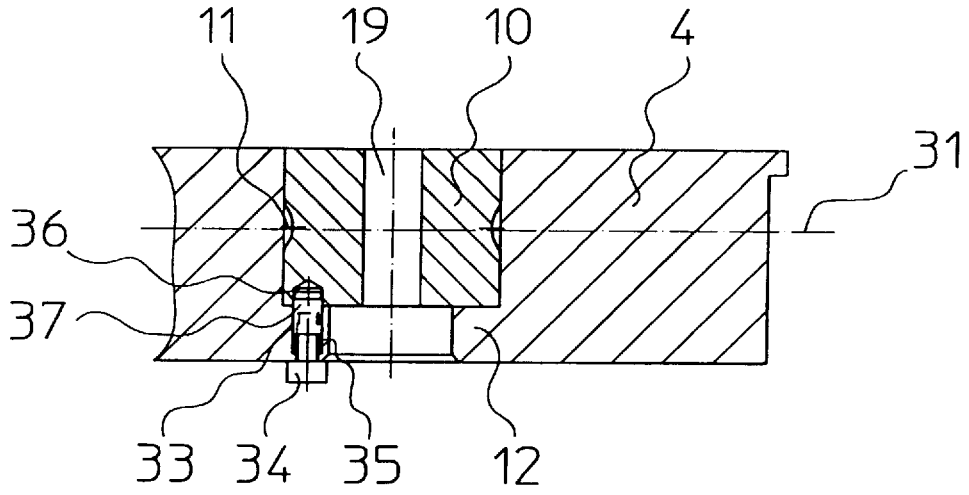
FIG. 7 is a vertical sectional view through the second embodiment of the die-fixing device.
Figure 8:
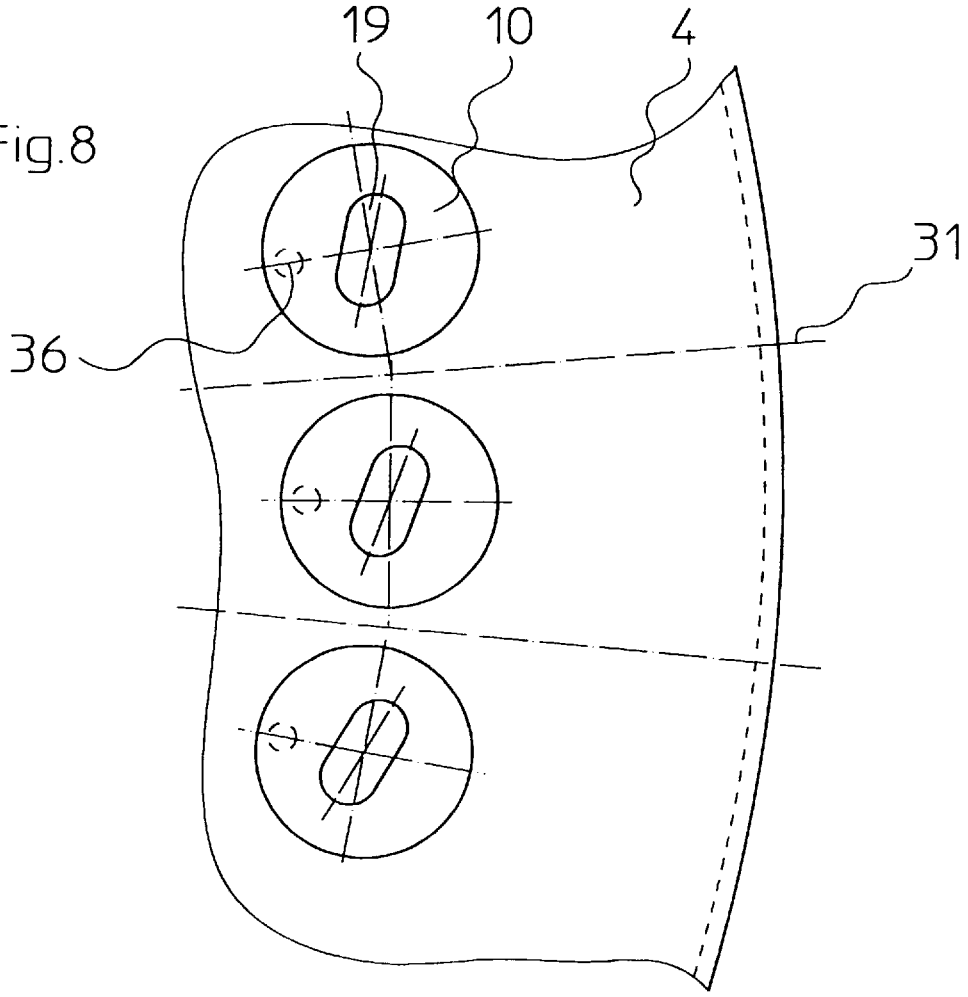
FIG. 8 is a top view of the embodiment of FIG. 7.

In the third embodiment of the die-fixing device shown in FIGS. 7 and 8, a centering pin acting as a centering piece 34, which is held in the projecting position shown in FIG. 7 by means of a coil spring 35 supported at the bottom of the hole 33, is located in a hole 33 from the underside on the die table 4 in the circular collar 12 of the mounting hole 6 for the shaped die 10. The underside of the shaped die 10 is provided with a centering surface 36 designed as a centering hole, into which the free end 37 of the centering pin 34 extends. The free end 37 of the centering pin 34 snaps into the centering hole 36 on the underside of the shaped die 10 during the mounting of the shaped die 10. As a result, the shaped die 10 with its mold cavity 19 is fixed in the mounting hole 6. The shaped die 10 is then fixed by the die screw 5 in the axis 31, as was described above in connection with the first exemplary embodiment. If round, standard dies are used, which are made without a fitting hole 36, the front surface of the shaped die 10, which is aligned in the direction of the centering pin 34, presses the centering pin 34 downward during mounting, and the elastic yielding movement is guaranteed by the coil spring 35.

Figure 9:
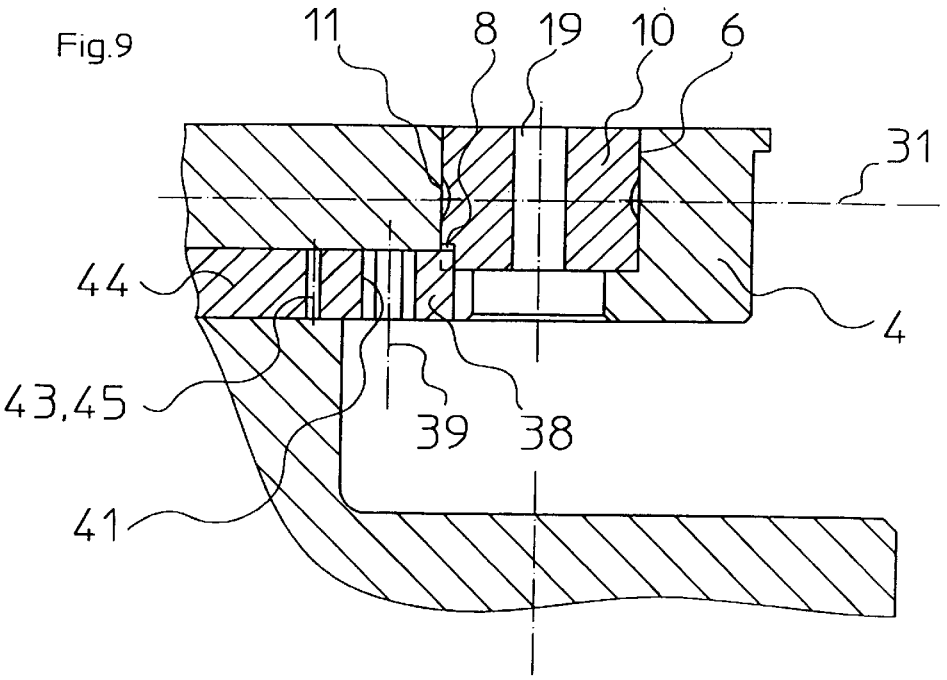
FIG. 9 is a vertical sectional view through the fourth embodiment of the die-fixing device.
Figure 10:
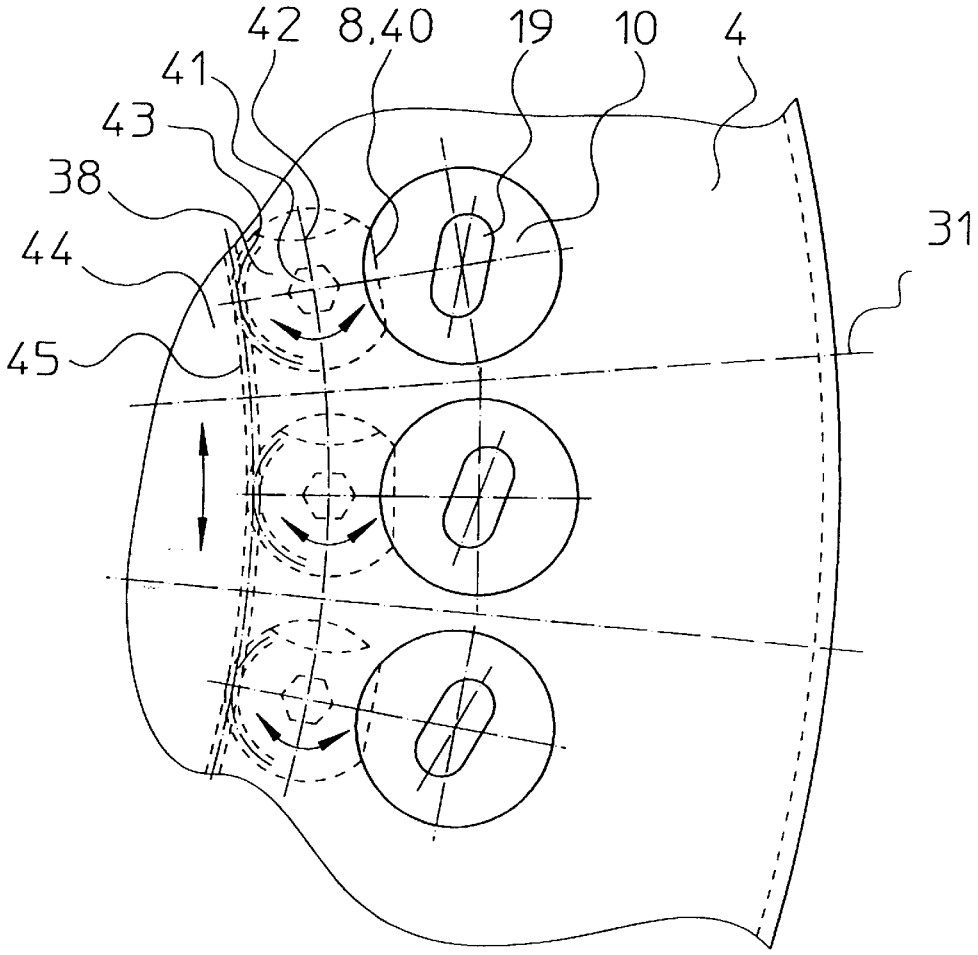
FIG. 10 is a top view of the embodiment of FIG. 9.

In the fourth embodiment of the die-fixing device shown in FIGS. 9 and 10, one centering piece 38 each, which is designed as a centering disk and is mounted rotatably around its axis 39 in the die table 4, is located per shaped die 10 on the underside of the die table 4. The shaped die 10 comprises one centering surface 8. The centering disk 38 comprises a centering surface 40 adapted to this. If the centering disk 38 is turned into the fixing position by hand by means of an Allen wrench engaging a hexagonal opening 41, the centering disk 38 with the centering surface 40 extends into the mounting hole 6 for the shaped die 10. The shaped die 10 can be mounted only if the centering surface 40 of the centering disk 38 is congruent with the centering surface 8 of the shaped die 10, as is shown in FIGS. 9 and 10. To insert round, standard dies, the centering disk 38 comprises another, arc-shaped centering surface 42. If round, standard dies are inserted into the die table 4, the centering disks 38 must have been brought in advance, by clockwise rotation, into the position in which the arc-shaped centering surface 42 is aligned with the mounting hole 6 for the dies in the die table 4, so that a round, standard die can be inserted. The centering disks 38 can be adjusted individually by hand by means of an Allen wrench.

A central mechanical adjustment is also possible. The centering disks 38 are provided for this purpose with external teeth 43 over a corresponding angle range, and these external teeth engage a toothed ring 44, whose outer circumference is likewise provided with external teeth 45. If the toothed ring 44 is rotated by hand or automatically to the left or right via a corresponding drive, not specifically shown, all centering disks 38 of all dies 10 are optionally rotated into the desired positions, in which the centering surfaces 40 extend into the mounting hole 6 for the shaped dies 10, or the arc-shaped centering surfaces 42 are aligned flush with the circularly cylindrical mounting hole 6 for mounting round, standard dies.

While specific embodiments of the invention have been shown and described in detail to illustrate the application of the principles of the invention, it will be understood that the invention may be embodied otherwise without departing from such principles.

LIST OF REFERENCE NUMBERS

1 Rotary tabletting press
2 Upper punch
3 Lower punch
4 Die table
5 Die screw
6 Mounting hole
7 Die holder
8 Centering surface
9 Centering surface
10 Shaped die
11 Annular T-slot
12 Collar
13 Drive shaft
14 Rotor axis
15 Rotor upper part
16 Rotor lower part
17 Pitch circle
18 Die body
19 Mold cavity
20 Die pin
21 Rotor
22 Guide groove
23 Fitting piece
24 Screw
25 Feather key
26 Guide sleeve
27 Guide sleeve
28 Centering piece
29 Tightening screw
30 Guide pin
31 Axis
32 Elongated hole
33 Hole
34 Centering piece/pin
35 Coil spring
36 Centering surface/hole
37 Free end
38 Centering piece/disk
39 Axis
40 Centering surface
41 Hexagonal opening
42 Centering surface
43 External teeth
44 Toothed ring
45 External teeth

We claim:

1. A device for fixing shaped dies, which are provided with asymmetrical mold cavities, are circularly symmetrical on an outer circumference and are fastened by means of die holders engaging annular T-slots in a die table of a rotary tabletting press, the device comprising:

a centering surface for each shaped die, associated with said asymmetrical mold cavities;

a centering piece engaging said centering surface, said centering piece being detachably or movably arranged on said die table for each of said shaped dies.

2. A device in accordance with claim 1, further comprising:

a tightening screw for detachably fastening said centering piece and a guide pin for accurate positioning of said centering piece in the die table.

3. A device in accordance with claim 1, wherein a tapered pin is provided for fixing said centering piece in the die table.

4. A device in accordance with claim 2, wherein said guide pin is tapered for fixing said centering piece in the die table.

5. A device in accordance with claim 1, wherein a straight pin is provided for fixing the said centering piece in the die table.

6. A device in accordance with claim 2, wherein said guide pin is a straight pin for fixing the said centering piece in the die table.

7. A device in accordance with claim 1, wherein said centering piece is designed as a centering disk, said centering disk being rotatably mounted on an underside of said die table, and said centering piece is provided with a first centering surface on a circumference for engaging said centering surface of the shaped die and with a second, arc-shaped centering surface, said arc-shaped centering surface being aligned with a circularly cylindrical mounting hole of the die table for said shaped dies, after a rotation of said centering disk.

8. A device in accordance with claim 7, further comprising a rotatable toothed ring, said centering disk being provided with external teeth over a portion of a circumference of said centering disk, said external teeth engaging external teeth of said rotatable toothed ring for rotating said centering disk.

9. A device for fixing shaped dies, which are provided with asymmetrical mold cavities, are circularly symmetrical on an outer circumference and are fastened by means of die holders engaging annular T-slots in a die table of a rotary tabletting press, the device comprising:

a centering surface for each shaped die, associated with said asymmetrical mold cavities;

a centering piece engaging said centering surface, said centering piece being detachably or movably arranged on said die table for each of said shaped dies;

a guide groove arranged on an underside of the die table, said centering piece being arranged axially displaceably in said guide groove arranged on an underside of said die table.

10. A device in accordance with claim 9, further comprising an elongate hole provided in said centering piece;

a tightening screw extending through said elongate hole.

11. A device for fixing shaped dies, which are provided with asymmetrical mold cavities, are circularly symmetrical on an outer circumference and are fastened by means of die holders engaging annular T-slots in a die table of a rotary tabletting press, the device comprising:

a centering surface for each shaped die, associated with said asymmetrical mold cavities;

a centering piece engaging said centering surface, said centering piece being detachably or movably arranged on said die table for each of said shaped dies;

a collar in the underside of the die table, said collar having a hole, said centering surface being formed as a centering hole on an underside of said shaped die, said centering piece including a spring-loaded guide pin inserted into said hole of said collar and elastically engaging said centering surface.

* * * * *